US007334841B2

(12) United States Patent
Chou

(10) Patent No.: US 7,334,841 B2
(45) Date of Patent: Feb. 26, 2008

(54) ANGLE ADJUSTMENT MECHANISM FOR LUMBAR SUPPORT OF CHAIR BACKREST

(76) Inventor: Kuo-Ching Chou, No. 29-10, Nioujhuang, Tianan County 741, Shanhua Township (TW)

( * ) Notice: Subject to any disclaimer, the term of this patent is extended or adjusted under 35 U.S.C. 154(b) by 130 days.

(21) Appl. No.: 11/164,516

(22) Filed: Nov. 28, 2005

(65) Prior Publication Data

US 2007/0120405 A1 May 31, 2007

(51) Int. Cl.
*A47C 7/46* (2006.01)
*A47C 7/14* (2006.01)
*A47C 3/026* (2006.01)

(52) U.S. Cl. ..... 297/284.4

(58) Field of Classification Search ..... 297/284.4
See application file for complete search history.

(56) References Cited

U.S. PATENT DOCUMENTS

| | | | | |
|---|---|---|---|---|
| 4,913,495 | A * | 4/1990 | Nagasaka et al. | 297/284.4 |
| 4,950,032 | A * | 8/1990 | Nagasaka | 297/284.4 X |
| 6,189,972 | B1 * | 2/2001 | Chu et al. | 297/284.4 |
| 6,260,921 | B1 * | 7/2001 | Chu et al. | 297/284.4 |
| 6,354,662 | B1 * | 3/2002 | Su | 297/284.4 X |
| 6,378,942 | B1 * | 4/2002 | Chu | 297/284.4 |
| 6,688,687 | B2 * | 2/2004 | Chu | 297/284.4 |
| 6,755,467 | B1 * | 6/2004 | Chu | 297/284.4 X |
| 6,811,215 | B2 * | 11/2004 | Horiki et al. | 297/284.4 X |
| 6,848,744 | B1 * | 2/2005 | Raftery et al. | 297/284.4 X |
| 6,981,743 | B2 * | 1/2006 | Edwards et al. | 297/284.4 X |
| 2002/0060485 | A1 * | 5/2002 | Fischer et al. | 297/284.4 |
| 2005/0006935 | A1 * | 1/2005 | Chang | 297/284.4 |
| 2006/0097556 | A1 * | 5/2006 | Jang | 297/284.4 |
| 2007/0069564 | A1 * | 3/2007 | Lee | 297/284.4 |

FOREIGN PATENT DOCUMENTS

| | | | | |
|---|---|---|---|---|
| GB | 2165445 A | * | 4/1986 | 297/284.4 |
| JP | 06133831 A | * | 5/1994 | 297/284.4 |

OTHER PUBLICATIONS

Taiwanese Utility Model No. 524084, Mar. 11, 2003, 6 pages.
Taiwanese Utility Model No. 573500, Jan. 21, 2004, 5 pages.

* cited by examiner

*Primary Examiner*—Rodney B. White
(74) *Attorney, Agent, or Firm*—Alan Kamrath; Kamrath & Associates PA

(57) ABSTRACT

A backrest of a chair has a recess for receiving an angle adjustable lumbar support. The lumbar support has a lower projection including a pair of cylindrical protrusions at both sides with resilient and metal gaskets put thereon, an outer gear formed around one of the pair of protrusions, and a through hole through the protrusions. A shaft assembly has inner teeth inserted into the through hole and secured by a washer and a elastic element. The lumbar support is secured to a plate of the chair, and the shaft assembly is movable on a sliding member by operating a lever of a manipulation assembly. Thus, the lumbar support is adjustable by manipulating the lever so as to cause the inner teeth to be disengaged from the gear. The lumber support is positioned by releasing the lever so as to cause the shaft assembly to force the gear and the inner teeth to be engaged together due to the expansion of the elastic element.

5 Claims, 7 Drawing Sheets

ANGLE ADJUSTMENT MECHANISM FOR LUMBAR SUPPORT OF CHAIR BACKREST

BACKGROUND OF THE INVENTION

1. Field of Invention

The present invention relates to mechanisms which enable components of a chair to be adjustably positioned relative to one another, and more particularly to an improved angle adjustment mechanism for a lumbar support of chair backrest.

2. Related Art

Ergonomic chairs are gaining popularity in recent years. There is one type of chair having an angle adjustment mechanism for a lumbar support of a backrest available.

For example, a conventional angle adjustment mechanism for a lumbar support in accordance with the prior art as disclosed in Taiwan Utility Model No. 573500, comprises several longitudinally arranged guide grooves formed in a middle section of a backrest support for accommodating a pair of rods projecting from the back of a waist rest.

Taiwan Utility Model No. 524084 disclosed another conventional angle adjustment mechanism for a lumbar support to allow a waist to be adjustable up and down.

SUMMARY OF THE INVENTION

It is therefore an object of the present invention to provide an improved angle adjustment mechanism of a chair lumbar support which enables a user adjust the lumbar support to a desired angle by simple operation.

It is therefore an object of the present invention to provide a backrest of a chair having a recess for receiving an angle adjustable lumbar support, wherein the lumbar support has a lower projection including a pair of cylindrical protrusions at both sides with resilient and metal gaskets put thereon, an outer gear formed around one of the pair of protrusions, and a through hole through the protrusions. A shaft assembly has inner teeth inserted into the through hole and secured by a washer and an elastic element. The lumbar support is disposed on and secured to a plate of the chair. The shaft assembly is movable on a sliding member by operating a lever of a manipulation assembly. Thus the lumbar support is adjustable by manipulating the lever so as to cause the inner teeth to be disengaged from the gear, and is positioned by releasing the lever so as to cause the shaft assembly to force the gear and inner teeth to be engaged together due to the expansion of the elastic element.

The above and other objects, features and advantages of the present invention will become apparent from the following detailed description taken with the accompanying drawings.

DETAILED DESCRIPTION OF THE INVENTION

Figure 1:
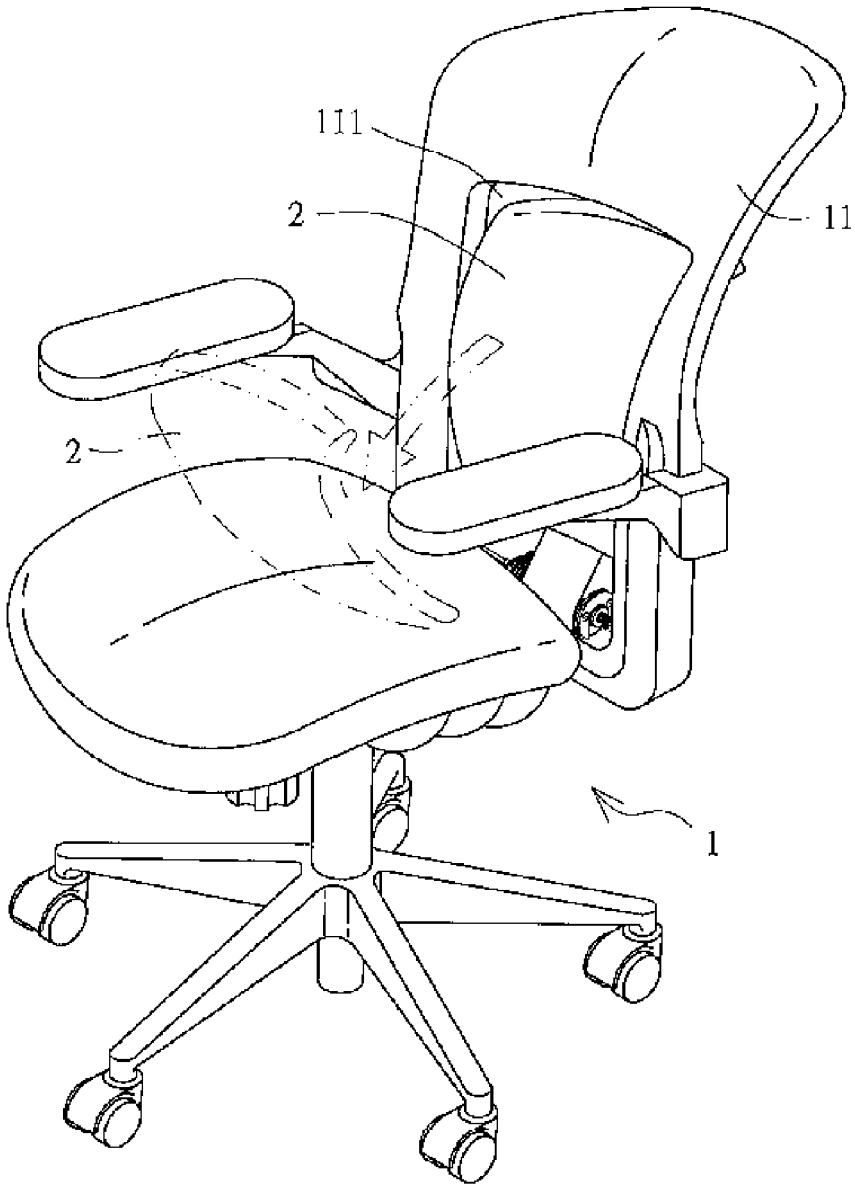
FIG. 1 is a perspective view of a chair including a backrest incorporating a lumbar support having an angle adjustment mechanism according to the invention.
Figure 2:
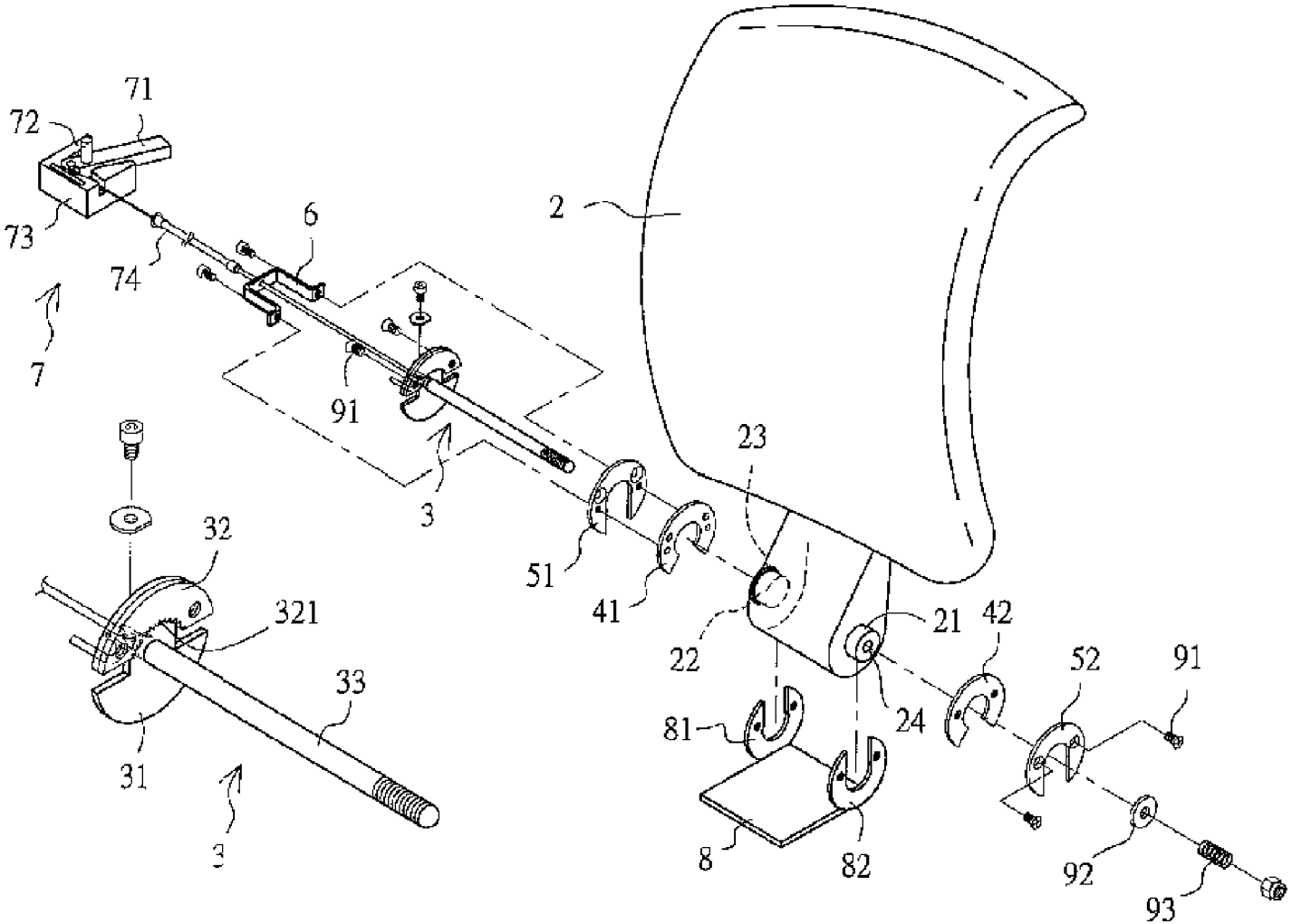
FIG. 2 is an exploded view of the mechanism.
Figure 3:
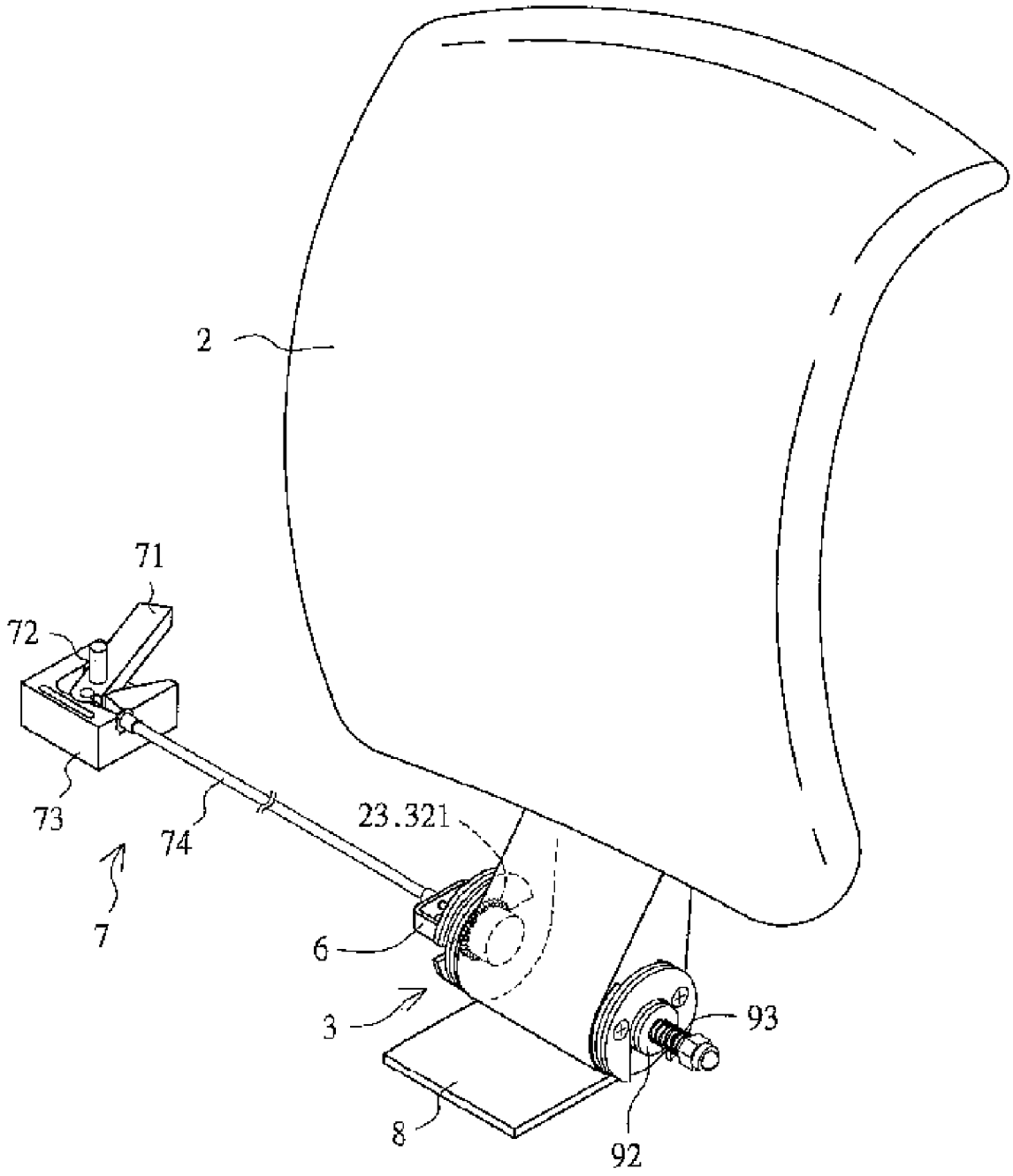
FIG. 3 is a perspective view of the assembled mechanism and lumbar support.
Figure 4:
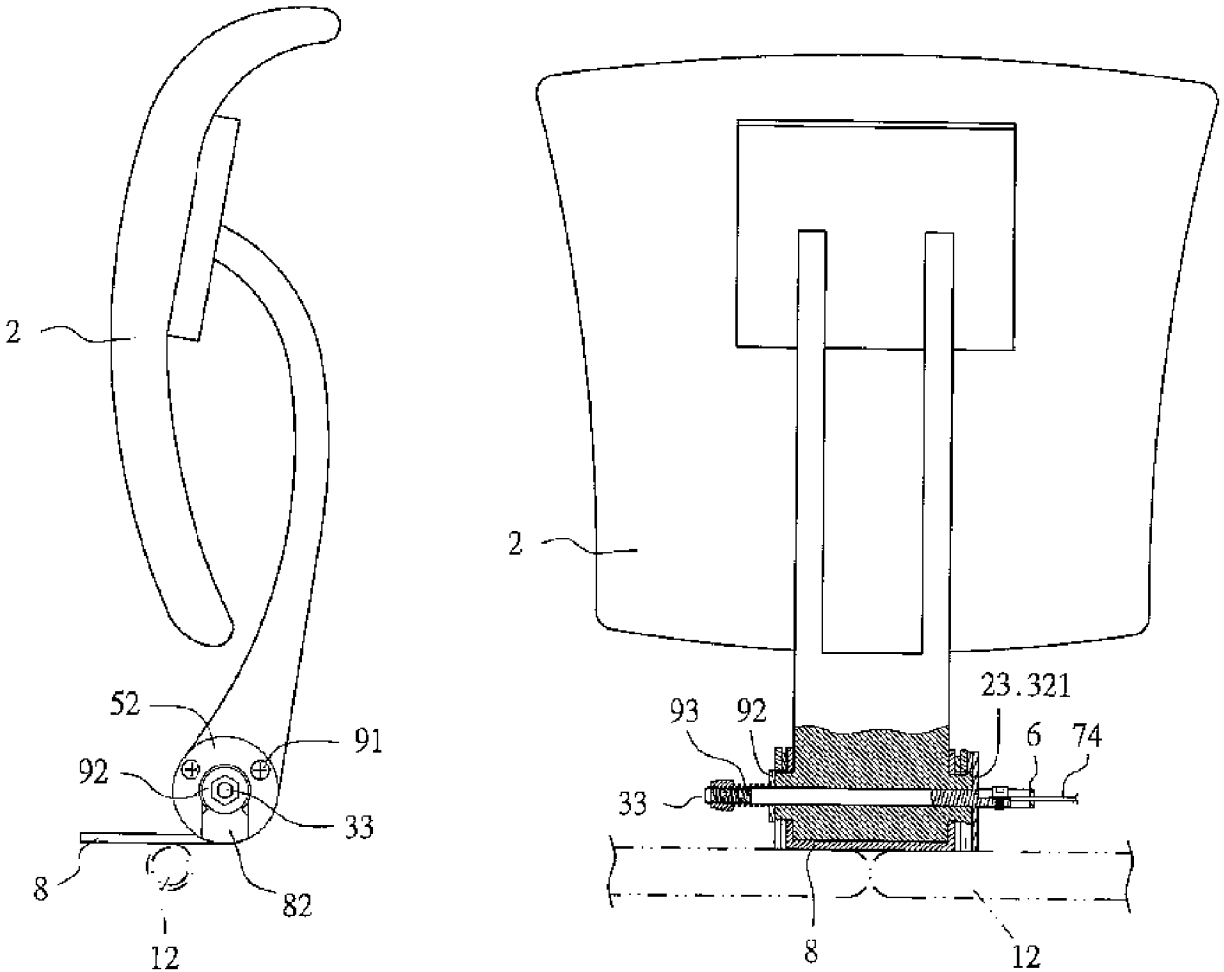
FIG. 4 shows a side view of FIG. 3 in a left portion and a rear view in part section of FIG. 3 in a right portion where the gear is engaged with the inner teeth.
Figure 5:
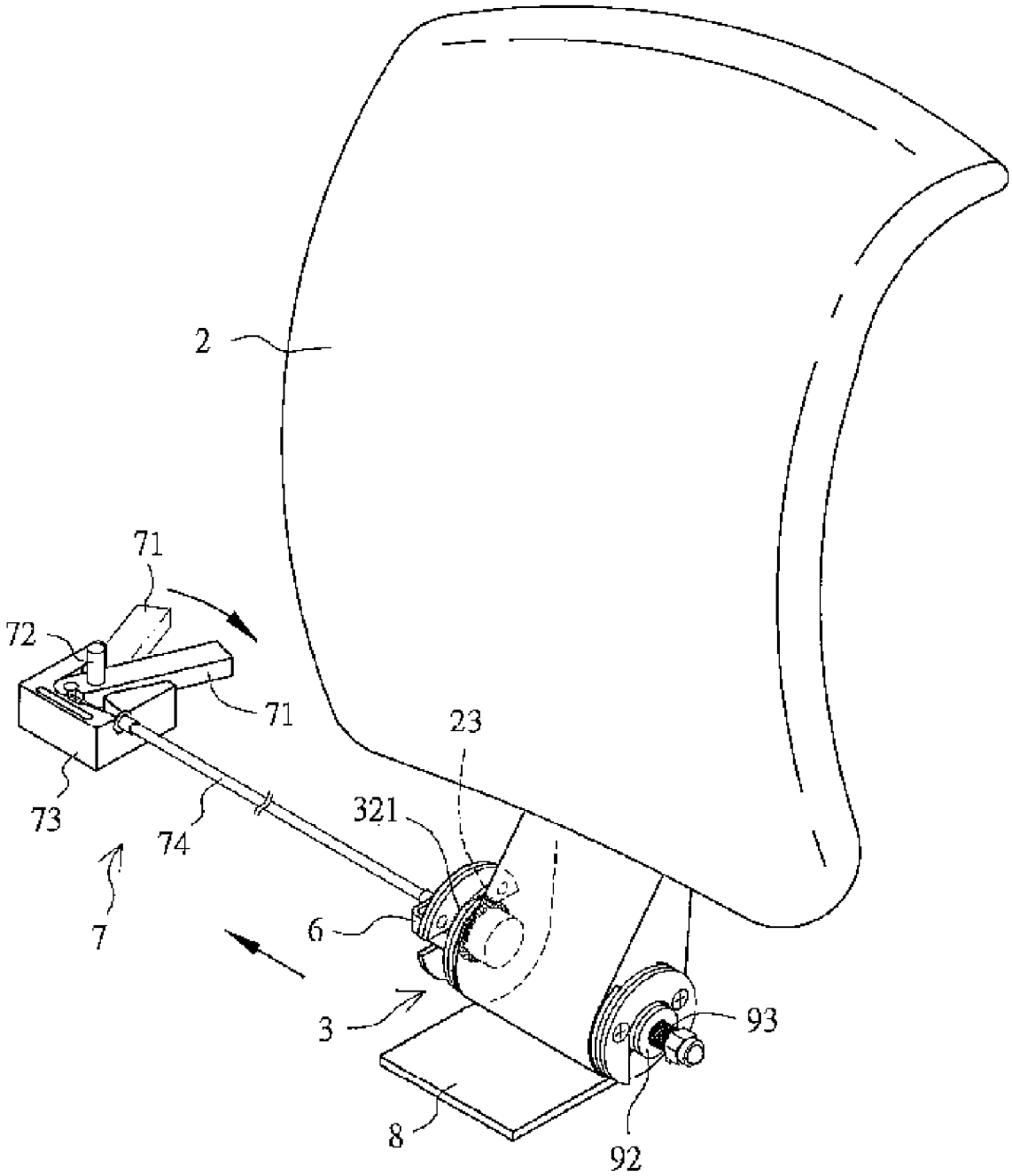
FIG. 5 is a view similar to FIG. 3 showing an angle adjustment operation of the mechanism.
Figure 6:
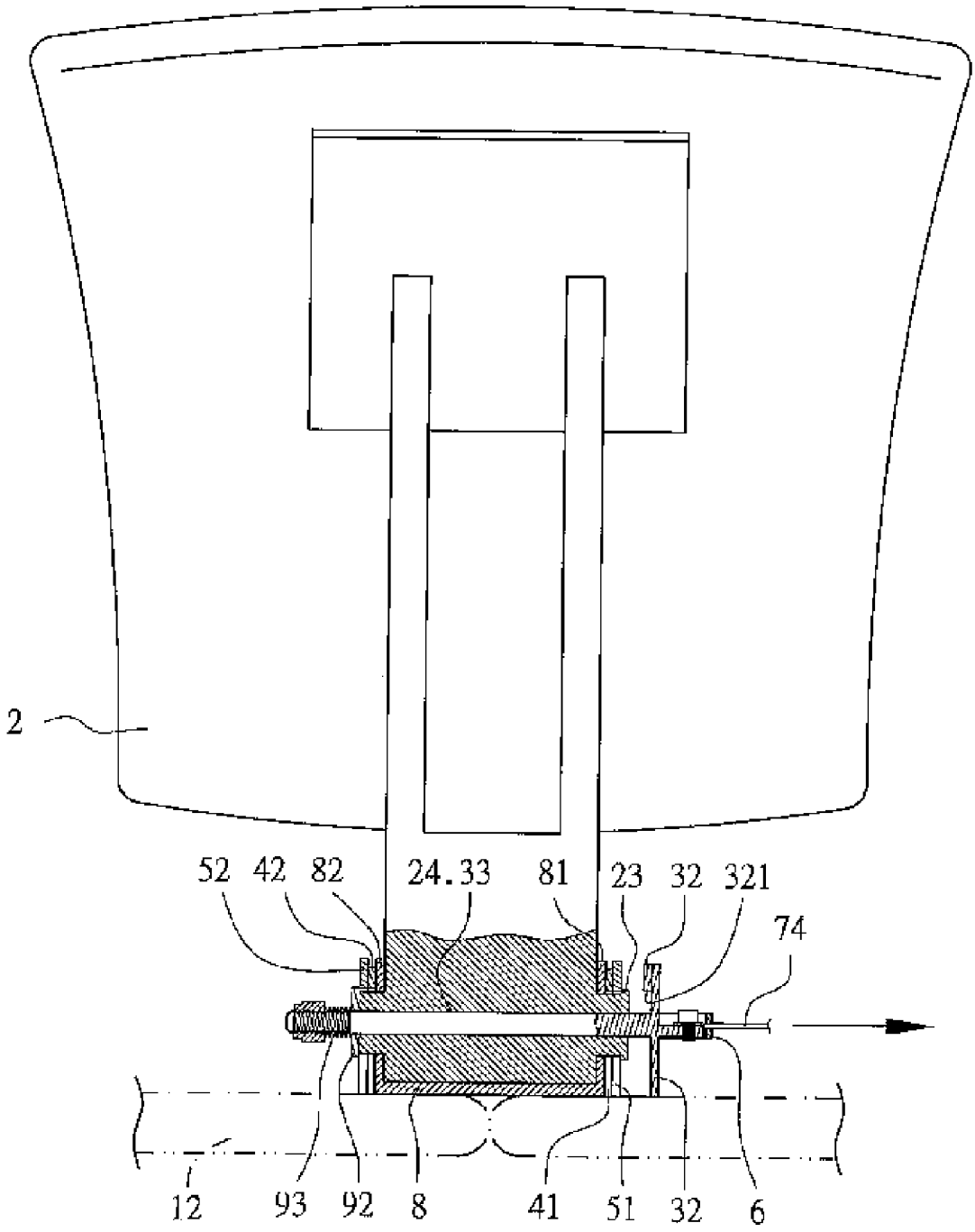
FIG. 6 is a view similar to the right portion of FIG. 4 further showing the angle adjustment operation of the mechanism where the gear is disengaged from the inner teeth.

Referring to FIGS. 1 and 2, a chair 1 including a backrest 11 having a recess 111 and a lumbar support 2 received in the recess 111 is shown. An angle of the lumbar support 2 relative to the seat can be adjusted by manipulating an angle adjustment mechanism according to the invention.

The lumbar support 2 comprises a lower projection including first and second cylindrical protrusions 21 and 22 at both sides, a gear 23 formed around the second protrusion 22, and a through hole 24 through the protrusions 21 and 22. The mechanism comprises the following components as discussed in detailed below.

A shaft assembly 3 consists of a first fixing member 31, a second fixing member 32 having inner teeth 321 on its inner edge, and a shaft 33 having threads on one end.

A manipulation assembly 7 consist of a lever 71 with a hole in the inner end, a body 73, a pivot pin 72 for pivotably fastening the lever 71 in the body 73, a rope 74 passing through a sliding member 6 having one end fastened in the hole of the lever 71 and the other end connected to the unthreaded end of the shaft 33.

A rectangular plate 8 combined with a rod 12 of the chair 1 comprises two C-shaped lugs 81 and 82 with cavities. The lugs 81 and 82 are provided with a plurality of apertures positionally related to apertures of resilient gaskets 41 and 42 and metal gaskets 51 and 52 for securable by fasteners 91.

In assembly, the resilient gasket 42 and metal gasket 52 are put on the first protrusion 22 and the resilient gasket 41 and metal gasket 51 are put on the second protrusion 21. Further, the shaft 33 is inserted through the through hole 24 and secured by a washer 92 and a elastic element 93. Further, the lumbar support 2 is disposed on and secured to the lugs 81, 82 of the plate 8.

Figure 7:
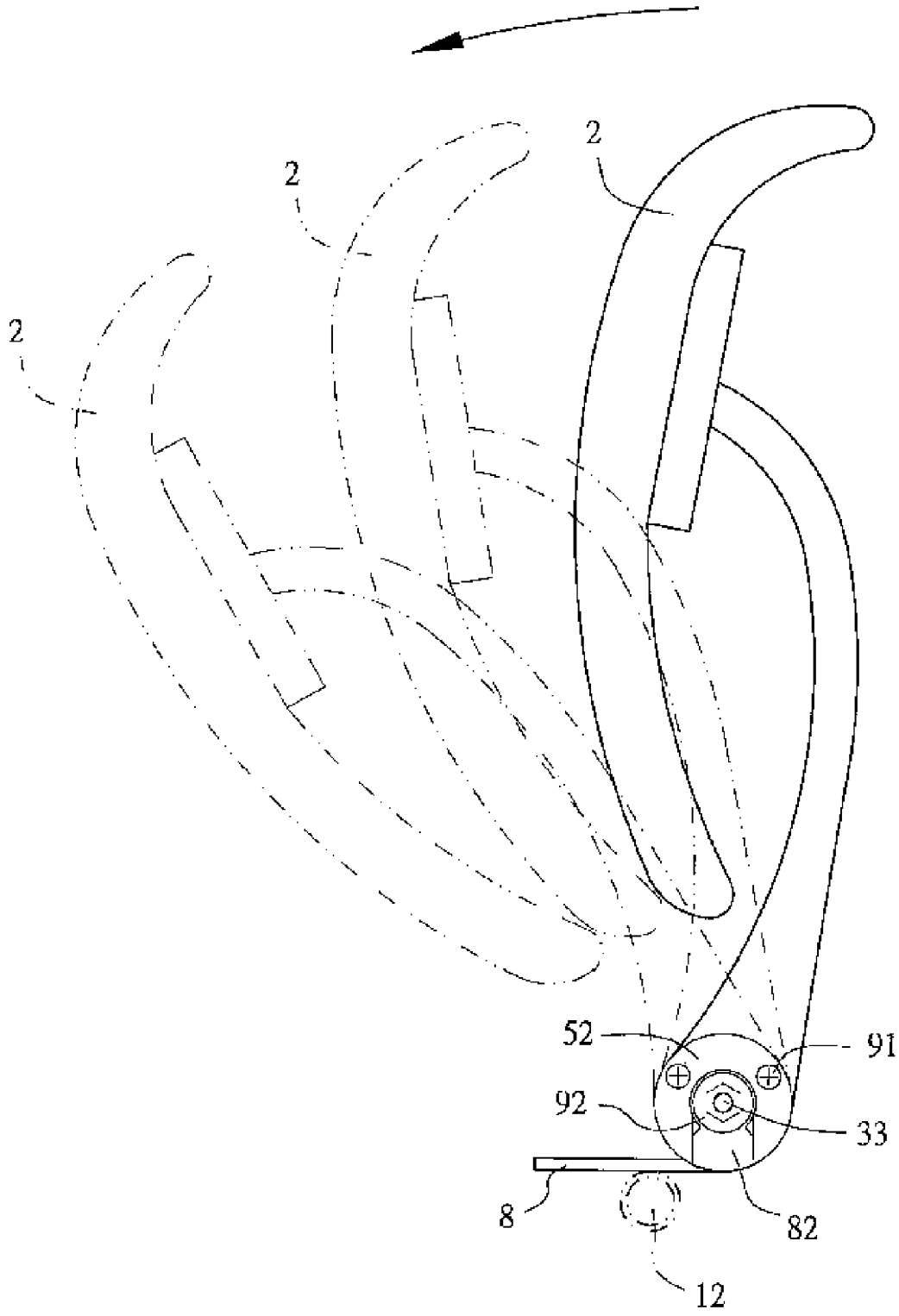
FIG. 7 is a view similar to the left portion of FIG. 4 showing the lumbar support being adjusted by manipulating the mechanism.

Referring to FIGS. 3 to 7 specifically, an angle adjustment operation of the mechanism will be described in detail below. A user may manipulate the lever 71 of the manipulation assembly 7 so that the shaft assembly 3 moves on the sliding member 6 so as to cause the lumbar support 2 to completely contact the user's waist. When the lever 71 is manipulated, referring to FIGS. 5 and 6, the inner teeth 321 of the shaft assembly 3 are disengaged with the gear 23 of the lumbar support 2 so that the lumbar support 2 is adjustable, as shown in FIG. 7. When the lever 71 is released, referring to FIGS. 3 and 4, the shaft assembly 3 will force the gear 23 and the inner teeth 321 to be engaged due to the expansion of the elastic element 93. Then, the lumbar support 2 is positioned.

While the invention herein disclosed has been described by means of specific embodiments, numerous modifications and variations could be made thereto by those skilled in the art without departing from the scope and spirit of the invention set forth in the claims.

What is claimed is:

1. A chair lumbar support adjustment mechanism, comprising an angle adjustable lumbar support which is combined with a backrest of a chair, with the lumbar support having a lower projection including a pair of cylindrical protrusions at both sides with metal gaskets put thereon, an outer gear formed around one of the pair of cylindrical protrusions, and a through hole through the said pair of cylindrical protrusions, a shaft assembly having inner teeth inserted into the through hole and secured by a washer and an elastic element, with the lumbar support being disposed on and secured to a plate of the chair;

with the lumbar support being adjustable when the inner teeth are disengaged from the gear and being positioned when the gear and the inner teeth are engaged together while the shaft assembly is retrieved due to the expansion of the elastic element.

2. A chair lumbar support adjustment mechanism, comprising an angle adjustable lumbar support which is combined with a backrest of a chair, with the lumbar support having a lower projection including a pair of cylindrical protrusions at both sides with resilient and metal gaskets put thereon, an outer gear formed around one of the pair of cylindrical protrusions, and a through hole through the pair of cylindrical protrusions, a shaft assembly having inner teeth inserted into the through hole and secured by a washer and an elastic element, with the lumbar support being disposed on and secured to a plate of the chair;

with the lumbar support being adjustable when the inner teeth are disengaged from the gear and being positioned when the gear and the inner teeth are engaged together while the shaft assembly is retrieved due to the expansion of the elastic element.

3. A chair lumbar support adjustment mechanism of claim 2, wherein the resilient gaskets are formed of one of plastic and rubber.

4. A chair lumbar support adjustment mechanism, comprising an angle adjustable lumbar support which is combined with a backrest of a chair, with the backrest having a recess for receiving the angle adjustable lumbar support, with the lumbar support having a lower projection including a pair of cylindrical protrusions at both sides with resilient and metal gaskets put thereon, an outer gear formed around one of the pair of cylindrical protrusions, and a through hole through the pair of cylindrical protrusions, a shaft assembly having inner teeth inserted into the through hole and secured by a washer and an elastic element, with the lumbar support being disposed on and secured to a plate of the chair, with the shaft assembly being movable on a sliding member by operating a lever of a manipulation assembly;

with the lumbar support being adjustable by manipulating the lever so as to cause the inner teeth to be disengaged from the gear, and being positioned by releasing the lever so as to cause the shaft assembly to force the gear and the inner teeth to be engaged together due to the expansion of the elastic element.

5. A chair lumbar support adjustment mechanism of claim 4, wherein the resilient gaskets are formed of one of plastic and rubber.

* * * * *